US005509743A

United States Patent [19]

Hao

[11] Patent Number: 5,509,743

[45] Date of Patent: Apr. 23, 1996

[54] CARTRIDGE FOR AUTOMATIC PENCIL

[76] Inventor: Yu Hao, No. 39 Wuning Rd., Qingdao, Shandong, P.R., China

[21] Appl. No.: 160,817

[22] Filed: Dec. 3, 1993

[30] Foreign Application Priority Data

Dec. 15, 1992 [CN] China ..... 92240238.8

[51] Int. Cl.[6] ..... B43K 21/22

[52] U.S. Cl. ..... 401/65; 401/53; 401/80; 401/81

[58] Field of Search ..... 401/53, 65, 80, 401/81, 67

[56] References Cited

U.S. PATENT DOCUMENTS

| | | | |
|---|---|---|---|
| 1,759,931 | 5/1930 | Barberon | 401/67 |
| 4,171,170 | 10/1979 | Kageyama et al. | 401/65 |
| 4,180,339 | 12/1979 | Katz | 401/65 |
| 4,452,544 | 6/1984 | Sumita | 401/81 X |
| 4,478,529 | 10/1984 | Morio | 401/53 |
| 4,538,934 | 9/1985 | Brunner | 401/53 |
| 4,687,363 | 8/1987 | Kageyama | 401/53 |
| 4,729,684 | 3/1988 | Sakaoka | 401/65 |
| 4,809,023 | 2/1989 | Brunner et al. | 401/53 X |

FOREIGN PATENT DOCUMENTS

| | | | |
|---|---|---|---|
| 88318 | 9/1983 | European Pat. Off. | 401/53 |
| 210350 | 2/1987 | European Pat. Off. | 401/65 |

*Primary Examiner*—Steven A. Bratlie

*Attorney, Agent, or Firm*—Burns, Doane Swecker & Mathis

[57] ABSTRACT

An automatic-pencil cartridge includes a lead automatic compensation device which is in the front section of the cartridge and which can be triggered to automatically output the lead for further writing when the lead is worn out and unsuitable for writing; a lead holder which is in the middle section of the cartridge and which can ensure that the lead is delivered only to the exit of the cartridge; a lead-storing device, which is in the back section of the cartridge and which can be used to store lead and to open the lead holder; a cup device, used to enclose the lead automatic compensation device and the lead holder with a retainer. The lead-storing device can be arranged in one end of the cup device.

16 Claims, 3 Drawing Sheets

CARTRIDGE FOR AUTOMATIC PENCIL

BACKGROUND

The invention relates to an automatic pencil cartridge which, like a refill of a ball-point pen, can be placed in a pencil body, and particularly to a cartridge that can be fitted in pencil bodies having different shapes.

In prior automatic pencils, cartridges normally can only be fitted in one kind of pencil body, and are made up of numerous components. This necessitates high technological requirements, causing much difficulty in assembly and mass-production. Besides, each kind of cartridge must go to its corresponding pencil body so that they are matched perfectly. This lack of interchangeability between a cartridge and a pencil body limits the using scope of automatic pencils.

Another disadvantage of such pencils is that during writing the lead has to be output by hand from time to time. What is worse, too much outputting may cause the lead to break while too little outputting may result in the scratching of paper.

Considering the above disadvantages of the prior art, an object of the invention is to provide an automatic pencil cartridge which has a compact and simple structure, can engage with pencil bodies having different shapes and automatically compensates the loss of lead during writing.

SUMMARY

According to an exemplary embodiment of the present invention, an automatic-pencil cartridge is provided, which comprises:

a lead automatic compensation means, which is in the front section of the cartridge, when the lead is worn out and unsuitable for writing, it will be triggered and automatically output the lead for further writing;

a lead holding means which is in the middle section of the cartridge, used to ensure that the lead can only be delivered to the exit of the cartridge;

a lead-storing means, which is in the back section of the cartridge, used to store lead and to switch on said one-way opening controller means;

a cup means, used to enclose said lead automatic compensation means and said lead holding means with a retaining means, and said lead-storing means is arranged in one end of said cup means.

Preferably, said lead automatic compensation means includes a lead-protecting element, a damping ring received in said lead-protecting element and a front spring, one end of which stands against the lead protecting tube.

The lead holding means preferably includes a locking element, in which a tapered section is provided and which can move up and down, and a holding element means fitting in the locking element. The holding element engages with the tapered section of said locking element and has a central hole whose opening or closing is controlled by said lead-storing means. The other end of said front spring stands against said holding element.

Preferably, a tapered section is formed at the central hole of the holding element and near the upper end thereof.

Preferably, said lead-storing means has a lead-guiding tube which is used to engage with said tapered section of the holding element to switch on the lead holding means.

Preferably, said lead-storing means consists of a lead-entering tube which is fixed on the lead-guiding tube; the diameter of the upper section of the lead-entering tube is greater than that of its lower section; a lead-storing tube is fixed on the thinner section of said lead-entering tube.

Preferably, said cartridge also includes an extending tube that is fixedly connected with the locking element; a projection means is formed in the extending tube, the thicker section of said lead-entering tube can be relatively slidable inside the guiding tube; a groove means is formed in the thicker section of the lead-entering tube and cooperates with the projection means of the lead-guiding tube; inside said cup means, a radial projection means is provided to position the lead-entering tube.

Preferably, two ends of a lead-feeding spring act on the upper end of the locking element and the lower end of the lead-entering tube respectively.

Preferably or alternatively, two ends of a lead-feed spring act on the radial projection of said cup means and the lower end of the lead-storing tube.

Ingeniously constructed, compact in structure and reliable in performance, exemplary embodiments of the cartridge presented in the invention can compensate the lead loss automatically and be manufactured to be a standardized product. In this way, the length of the lead outside the cartridge can always be kept as long as 0.3 mm or 0.5 mm, for example. Such lengths are ideal for writing with no possible lead-breaking under normal writing pressure. When one lead has been consumed, just by giving the cartridge a number of on-and-off presses, the second lead will be delivered to its place for further writing.

Further objects and advantages of the invention will appear from the following description taken together with the accompanying drawings.

DETAILED DESCRIPTION OF THE PREFERRED EMBODIMENTS

The first reference is made to FIGS. 1–5, which present a first embodiment of the cartridge.

The automatic pencil cartridge according to the first embodiment of the invention will be described in detail below.

Figure 2:
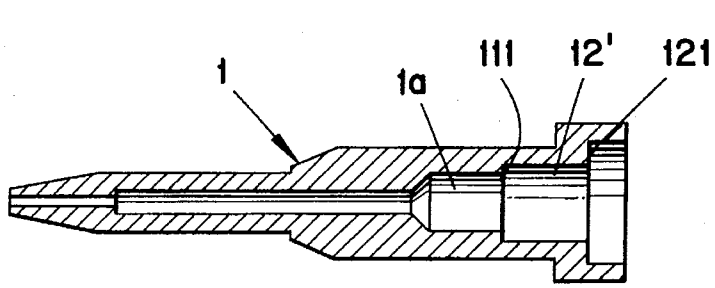
FIG. 2 is an enlarged sectional view of an exemplary lead-protecting element.
Figure 5:
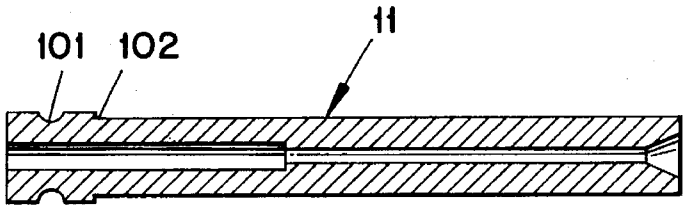
FIG. 5 is an enlarged sectional view of a lead-entering tube.

A lead-protecting element 1 is arranged at the front portion of the whole cartridge. In lead-protecting element 1 is formed a stepped central hole (as shown in FIG. 2). A damping ring 2 seats fixedly in the central hole section 1*a* of lead-protecting element 1 and can be moved integrally therewith. A lead (not shown), extending in lead-protecting element 1 and passing through the central hole of the damping ring 2, is gripped tightly by damping ring 2, producing a frictional engagement between the lead and the ring. Front spring 3, whose lower end is inserted in central hole section 12' of lead-protecting element 1, presses against a shoulder 111 formed in the section 12'. The upper end of the front spring stands against the lower surface of a holding element 5 which will be described in detail below. The lead-protecting element 1 has its upper end inserted into the central hole of a retaining element 4 and pliably engage therewith. The retaining element 4 is fixed on the lower end of a cup 13. A locking element assembly is slidably installed in cup 13 and spaced from upper end of the lead-protecting element 1. Preferably the space is 1 mm. The locking element assembly may be made into an integral one, but in this embodiment, it comprises a locking element 7 and an extending tube 8. The locking element 7 and the extending tube 8 are fitted tightly to form an assembly, which makes it easier for the whole cartridge to be assembled and manufactured. The locking element 7 have gradually enlarged central hole at the lower end to form an inner tapered section 71, which is used to engage with the holding element 5. One or more inner projections 81 are formed and extend radially from the inner wall of the central hole of the extending tube 8.

Figure 1:
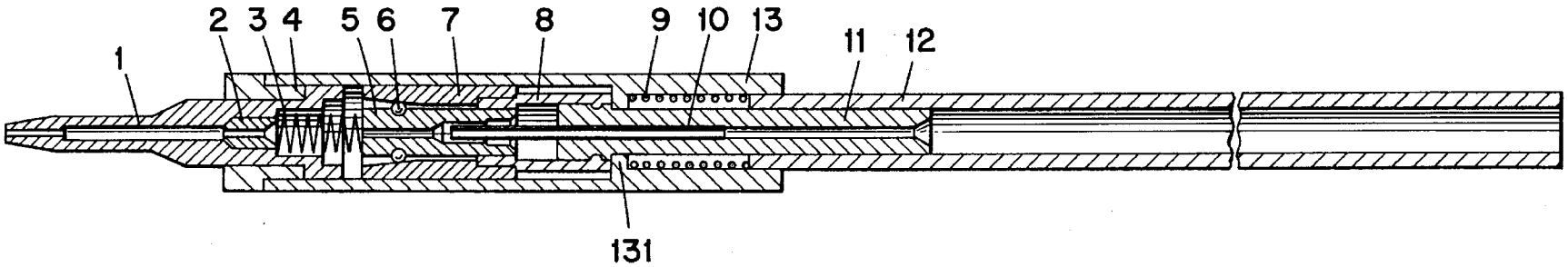
FIG. 1 is a sectional view of the automatic pencil cartridge according to a first embodiment of the present invention.
Figure 4:
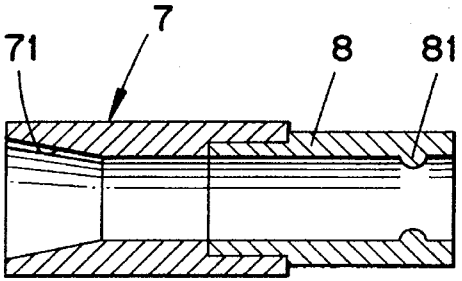
FIG. 4 is an enlarged sectional view of an exemplary locking element assembly.
Figure 3:
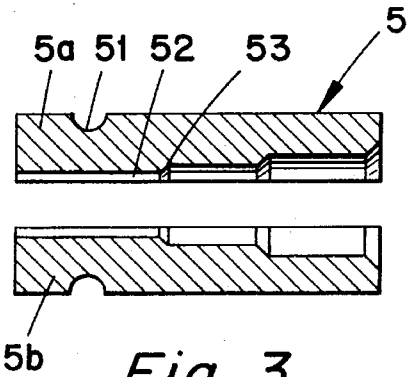
FIG. 3 is an enlarged sectional view of a holding element, in which the holding element consists of two parts.

As shown in FIG. 1 and FIG. 3, the holding element 5 slidably fits inside the locking element assembly. In the embodiment, the holding element 5 is made up of two semi-columnar parts 5*a* and 5*b*. It may also be made up of three ⅓-columnar parts, or simply, it can be made into an integral part whose side wall has grooves. Steel balls 6 are installed in the pits 51 formed near the lower end of the holding element 5 and engage with the tapered section 71. The upper end of front spring 3 standing against the lower end of holding element 5, push upwardly the holding element 5. The upward movement of the element 5 causes the steel balls 6 to fit the tapered section 71 tightly, thereby making semi-columnar parts 5*a* and 5*b* close tightly. This closed position of 5*a* and 5*b* is called locking state below. The semi-columnar parts 5*a* and 5*b* each have a stepped groove on one longitudinal side. These grooves form the stepped central hole 52 of the holding element 5. A tapered section 53 is provided in the hole 52 near the upper end of the holding element 5. The section 53 is used to engage with a lead-guiding tube 10 which will be described later. The lead, placed in the central hole 52, can be gripped tightly by the lower section of central hole 52. The diameter of the lower section of the central hole 52 is a little less than that of the lead-guiding tube 10.

The lead-guiding tube 10 is fixed in the lower section of a lead-entering tube 11, forming an assembly therewith comprising both tubes 10 and 11. The central hole in the lead-entering tube 11 is gradually enlarged at the upper section for easy-delivering of the lead. The diameter of the lower section of the lead-entering tube 11 is greater than that of the upper section thereof. A shoulder 102 is formed between the two sections. A projection 131 is formed on the inner wall of the cup 13 and extends therefrom to position lead-entering tube 11 by engaging with the shoulder 102. The lead-entering tube 11 has recesses 101 formed in its outer surf ace of the thicker section of tube 11, which have a shape and number corresponding to that of the projections 81 formed in the extending tube 8. When the lower end of the assembly, comprising both lead-guiding tube 10 and lead-entering tube 11, is slidably inserted into the upper section of extending tube 8, the recesses 101 cooperate with projections 81, and the lead-guiding tube 10 extends into, without any contact, the upper section of the central hole 52 of the holding element 5. A lead-feeding spring 9 is arranged in the cup 13, with one end thereof pressing against the projections 131. The lower section of lead-storing tube 12, fixedly encased on the upper section of the lead-entering tube 11, is inserted slidably into the cup 13 to fix lead-feeding spring 9.

Thus, the lead-protecting element 1, damping ring 2, front spring 3, holding element 5, steel balls 6, locking element 7, extending tube 8, lead-guiding tube 10 and lead-entering tube 11 are all enclosed in the cup 13 and are sealed by the retaining element 4. Besides, lead-storing tube 12 encases the thinner section of lead-entering tube 11 to fix lead-feeding spring 9 on the upper part of cup 13, whereby, a complete sealed cartridge that can output lead automatically if formed.

The process of lead-compensation of an exemplary automatic pencil is described below:

In practice, one lead extends a desired length out of lead-protecting element 1 for writing. The writing will produce a writing pressure which can reach a maximum of 650 g. This pressure, when acting on the lead, will push it backwardly. The backward motion of the lead will cause the holding element 5, which grips tightly the lead, to move backwardly, making steel balls 6 move backward a little along the tapered section 71 of the locking element 7. By the engagement of the tapered section 71 and the balls 6, holding element 5 is not able to move any further. Meanwhile, holding element 5, acted on by steel balls 6, grips the lead more tightly to prevent the lead from moving back upward, whereby a normal writing can be achieved.

When the lead being out of cartridge has worn out, the writing pressure will directly act on the front end of the lead-protecting element 1, making the lead-protecting element move backward to compress front spring 3. This compression will produce a biased spring 3 which has a restoring force. Preferably the restoring force is 25 g. The contact between the damping ring 2 and the lead will produce a frictional force which is 50 g in this embodiment. However, due to the fixed connection between lead-protecting element 1 and damping ring 2 and because the writing pressure acting on lead-protecting element 1 is much greater than the frictional force and restoring force mentioned above, the lead-protecting element 1 with the ring 2 will move backwardly while the lead still remains in its place. Thus, another section of the lead will be delivered out of the lead-protecting element, due to that backward motion.

When the pencil is lifted during writing intermittently, the writing pressure acting on the lead-protecting element will disappear, with the result that lead-protecting element 1 with damping ring 2 resumes its original place, acted on by the restoring force of front spring 3. Due to the frictional force between damping ring 2 and the lead, the lead-protecting element will bring the lead downwardly. The lead will in turn pull holding element 5 downwardly, making the balls 6 move downward along the tapered section 71 to have the holding element 5 release the lead. The lead is thus able to be pulled out of the holding element 5, moving together with the lead-protecting element 1 in such a manner that a certain length of lead is out of the front end of lead-protecting element 1. The loss of lead is thus compensated to meet the needs of continuous writing. The automatic compensation for the lead loss has thus been realized. Afterwards, acted on by front spring 3, the holding element 5 also resumes its original place and the steel balls 6 on the outer surface of holding element 5 engage firmly against the tapered section 71 of the locking element 7. This ensures that the gripping force of the element 5 is greater than the writing pressure, which prevents the lead from moving back when writing is being done. In this way, the on-and-off pressure from writing makes lead-protecting element 1 move back and forth. This back-and-forth movement, together with the engagement among the damping ring 2, front spring 3, holding element 5, locking element 7 and steel balls 6, realizes the function of automatic lead-compensation.

The process of continuous output of the second lead, when the first lead is consumed, is described as follows:

When several leads have been stored vertically into the lead-storing tube 12, one of them will drop into the lead-guiding tube 10 through the enlarged upper section of the central hole of lead-entering tube 11. As the internal diameter of lead-guiding tube 10 is a little greater than the diameter of one lead, for example only 0.25 mm greater, only one lead is permitted to drop each time. Then the lead dropped reaches the upper end of the lower section of the central hole 52 of the holding element 5 through lead-entering tube 11 and lead-guiding tube 10. But as holding element 5 is now in locking state, the lead can not pass through until holding element 5 opens.

When a pressing force is applied on the lead-storing tube 12, the lead-feeding spring 9 is compressed. As lead-storing tube 12, lead-entering tube 11 and lead-guiding tube 10 are an assembly in which they fit tightly with one another and the recesses 101 in the lower end of lead-entering tube 11 engages with projections 81 of extending tube 8, lead-entering tube 11 and lead-guiding tube 10 can move downward, along with the locking element assembly and holding element 5, starting a first displacement. This displacement, which is 1 mm in the embodiment, makes front spring 3 compressed. This compression causes holding element 5 to be in the locking state during this first displacement. When the displacement ends, the lower end of locking element 7 will reach the position where it abuts against the upper end of lead-protecting element 1, so that further motion of locking element 7 is prohibited and the spring 3 has a restoring force of 25 g in this embodiment. Because extending tube 8 and locking element 7 are fitted together tightly, the former is also retained. However, lead-storing tube 12 will still push lead-entering tube 11 and lead-guiding tube 10 forward, starting a second displacement. The recesses 101 of lead-entering tube 11, under the pressure from the lead-storing tube 12, disengages from the engagement with the projections 81 in the extending tube 8, enabling lead-entering tube 11 to move downward relatively to the extending tube 8. In the meantime, pushed by lead-entering tube 11 and lead-storing tube 12, the lead-guiding tube 10 continues its motion. The downward movement of the lead-guiding tube 10 has its front end reach, move along and push against the tapered section 53 in the central hole 52 of the holding element 5, with the result that holding element 5 is pushed downward together with steel ball 6 while the locking assembly stays. Therefore, the locking element 7 will have its more enlarged section of tapered section 71 to engage with the balls of the holding engagement, whereby the holding element 5 is released and its two parts 5*a*, 5*b* are relaxed. The downward movement of the holding element 5 continues until its lower end reaches the shoulder 121 in the central hole of lead-protecting element 1, where its further motion is prohibited. By this time, shoulder 102 of the lead-entering tube 11 has also passed over projections 81.

The external diameter of lead-guiding tube 10 is greater than that of the lower section of the central hole 52 of holding element 5 which consists of two separate parts 5*a* and 5*b*. Thus, by means of the tapered section 53 in holding element 5, the further forward movement of the lead-guiding tube 10 makes the two parts 5*a* and 5*b* more apart, making the lead, already retained in holding element 5, drop onto the upper end of the central hole of damping ring 2 and await to be delivered into damping ring 2. When the first pressing is finished and the pressure on the tube 2 is released, the restoring force of the lead-feeding spring 9, which is 400 g in this embodiment, acts on lead-storing tube 12 which then brings lead-entering tube 11 and lead-guiding tube 10 to their original place. Owing to the hindering function between shoulder 102 of lead-entering tube 11 and the projections 81 in extending tube 8, during the return displacement on which locking element 7 moves upward by 1 mm, holding element 5 is in the state of openness. Thus, the lead is left on the upper end of the central hole of damping ring 2, awaiting to be sent into the damping ring. In this embodiment, during the whole process of return, after the locking-element assembly resumes its place and stands against projection 131, lead-entering tube 11, acted on by lead-feeding spring 9 to overcome the hindrance between the shoulder 102 and the projections 81, brings the lead-guiding tube 10 for further backward motion, causing lead-guiding tube 10 to be completely drawn out of the lower section of the central hole 52 and the tapered section 53. By this time, the holding element 5 is also pushed by front spring 3 to resume its position, again in a locking state. The lead section in the central hole of holding element 5 is gripped tightly again.

When the second pressing is made, the locking-element assembly and holding element 5 move downward simultaneously during the first displacement of 1 mm, with holding element 5 being in the locking state. This makes the gripped lead move forward by 1 mm, causing the lead already on the upper end of the central hole of the damping ring 2 to move into damping ring 2 by 1 mm. After such pressing is repeated several times, the process of output of a lead is completed. As mentioned above, in the whole process of output of the lead, two working displacements occur in series. In the first displacement, holding element 5 is in the locking state, while in the second displacement and when the whole cartridge has restored its place, holding element 5 is in the state of openness.

Figure 6:
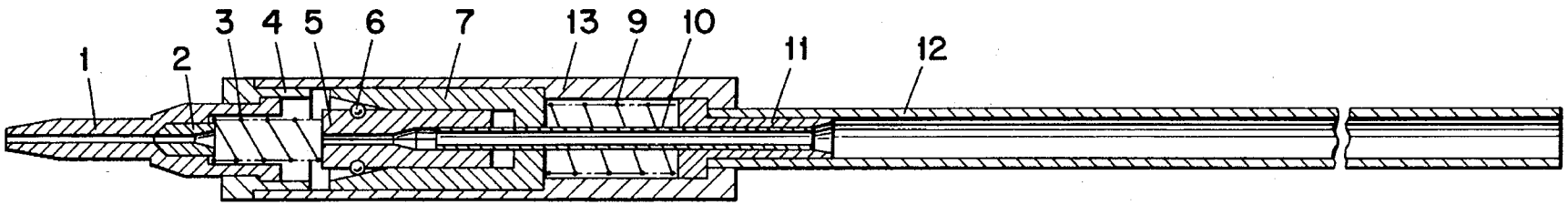
FIG. 6 is a sectional view of an automatic pencil cartridge according to a second embodiment of the present invention.

Referring to FIG. 6, the construction of the automatic-pencil cartridge according to the second embodiment of the presented invention will be described below. Compared with the first embodiment, this embodiment is different in the structure of the upper section of the cartridge.

In the description below, the parts that have the same function and similar structure as those in the first embodiment will be marked by the same numerals.

In the automatic pencil cartridge, according to a second embodiment the lead (not shown) extends out of the central hole of a lead-protecting element 1. A damping ring 2 is fixed in lead-protecting tube 1 as described in the first embodiment. The lower end of a front spring 3 is installed in lead-protecting element 1, while its upper end stands against the lower surface of a holding element 5. The upper section of the lead-protecting element 1 is slidably inserted into the central hole in a retaining element 4. The retaining element 4 is fixed on the lower end of a cup 13. The lead-protecting element 1, damping ring 2, front spring 3 are both arranged in the cup 13 and enclosed by the retaining element 4 to form an integral structure. A locking element 7 is placed in the middle section of the cup 13 and can slidably move relatively thereto. The lower end of the element 7 and the upper end of the retaining element 4 are spaced with a certain distance from each other. In the upper section of the cup 13, a lead-feeding spring 9 and a lead-entering tube 11 is arranged. The lead-feeding spring 9 has its lower end press against the bottom surface of the element 7 and its upper end stand against the lower end of the lead-entering element 11. A lead-guiding tube 10 is fixedly inserted in the central hole of the lead-entering tube 11, and passes through lead-feeding spring 9 and locking element 7. The lower end of lead-guiding tube 10 is inserted, without contact therewith, into the upper section of the central hole in holding element 5. The lower end of a lead-storing tube 12 fixedly encases the thinner section of lead-entering tube 11 and extends out of the hole formed in the bottom of the cup 13. The steel balls 6 are installed on the outer wall of the holding element 5 and engage with the tapered section inside the locking element 7.

Lead-protecting element 1, damping ring 2, front spring 3, holding element 5, steel ball 6, locking element 7, lead-feeding spring 9, lead-entering tube 11 and lead-guiding tube 10 are all encased in cup 13 and sealed by retaining element 4. Lead-storing tube 12, which seats in the lead-entering tube 11, is inserted into the cup 13. Thus, a completely sealed automatic-pencil cartridge is formed. It can be fitted in pencil bodies having various shapes. The front spring 3 has functions that it can push holding element 5 to grip the lead tightly as well as make the lead-protecting element resume its place. The engagement of the locking element 7 and the element 5 can both lock or clamp the lead tightly and deliver the lead to output by means of engagement with the damping ring 2.

The working process of the automatic-pencil cartridge according to this embodiment is described below.

When the lead has worn so short that it is unsuitable for writing, the on-and-off pressure from writing will push lead-protecting element 1 to move upwardly, as described in the above embodiment. When the pencil is lifted, the writing pressure is released and the lead-protecting element 1 will resume its place, acted on by front spring 3. By this time, the frictional force produced from the contact between the damping ring 3 and the lead will cause holding element 5 to be pulled to a lower position to release the lead. The lead is thus pulled out and the lead loss is compensated. Then, the restoring force of the front spring 3 acts on the holding element 5 to make it resume its place, with a result that the steel balls 6 on holding element 5 move along the tapered section of the locking element 7 and fit firmly thereagainst locking element 7. The engagement between the tapered section and the balls 6 ensures that the gripping force acting on the lead is greater than the writing pressure, so that the lead will not be pressed back during writing.

The process of continuous output of the second lead, when the first lead is consumed, is described as follows.

When several leads are put into lead-storing tube 12, one of them will drop into lead-guiding tube 10 through lead-entering tube 11. As the internal diameter of lead-guiding tube 10 is a little greater than external diameter of the lead, only one lead is permitted to drop into the lead-guiding tube 10. When the lead-storing tube 12 is pressed, lead-feeding spring 9 will be compressed. When lead-feeding spring 9 is so compressed that the force produced thereby is great enough to have the front spring 3 compressed, locking element 7 moves downward with the holding element 5 closing tightly, starting a first displacement which is 1 mm in this embodiment. When locking element 7 reaches the position where it is in contact with the upper end of the retaining element 4, its further motion is prohibited. However, lead-storing tube 12 will continue to push lead-entering tube 11 and lead-guiding tube 10 downward, starting a second displacement which is 1 mm in this embodiment. Lead-guiding tube 10, by pressing against the tapered section 53 in the central hole of the holding element 5, pushes the holding element downward, causing steel balls 6 to move downward to open holding element 5. Thus, the lead drops onto the upper end of the central hole of damping ring 2. Holding element 5 will not be prohibited from its further downward movement until its lower end touches the upper end of lead protecting element 1. Then, the pressing force on the lead-storing tube 12 is released and holding element 5 will resume its place, acted on by front spring 3. By this time, the first lead has reached damping ring 2. Then, the second press on lead-storing tube 12 will make holding element 5 to grip the lead and to push it downward into damping ring 2. After several such presses are done, the lead will be delivered out of the cartridge through lead-protecting element 1. In this way, when one lead is consumed, just by pressing the lead-storing tube several times, another one will come out.

It is noted that in this embodiment the restoring force of the spring 3 is preferably greater than that of the spring 9 when the above two displacements are finished.

As for the choice of lead for this invention, diameters such as 0.3 mm, 0.5 mm, 0.7 mm and 0.9 mm are all acceptable, and hardness and color of the lead can be varied.

While the description of this invention has been given with respect to preferred embodiments, it is not to be constructed in a limited sense. Variations and modification will occur to those skilled in the art. Reference is made to the appended claims for a definition of the invention.

What is claimed is:

1. An automatic-pencil cartridge, comprising:

lead automatic compensation means, which is in a front section of the cartridge, for automatically outputting lead for further writing when the lead is worn out and unsuitable for writing, said lead automatic compensation means comprising:

a lead-protecting element, a damping ring received in said lead-protecting element, and a front spring, one end of which stands against the lead protecting element;

lead holding means, which is in a middle section of the cartridge, for ensuring that the lead is delivered to an exit of the cartridge, said lead holding means comprising:

a locking element in which a tapered section is provided and which can move up and down, and a holding element fitting in the locking element, the holding element engages with the tapered section of the locking element and has a central hole in which a tapered surface is formed near an upper end thereof, wherein another end of said front spring stands against said holding element;

lead-storing means, which is in a back section of the cartridge, for storing lead and for opening said holding element, said lead storing means comprising a lead guiding tube fixedly mounted in said lead storing means, which lead guiding tube engages with the tapered surface of the holding element to open the holding element, said lead-storing means controls opening and closing of said holding element; and cup means for enclosing said lead automatic compensation means and said lead holding means with a retaining means, said lead-storing means being arranged in one end of said cup means.

2. A cartridge as claimed in claim 1, wherein said lead-storing means further comprises:

a lead-entering tube which is fixed on the lead-guiding tube, a diameter of a lower section of the lead-entering tube being greater than that of its upper section; and a lead-storing tube fixed on the upper section of said lead-entering tube.

3. A cartridge as claimed in claim 2, further comprising:

an extending tube that is fixedly connected with the locking element;

projection means formed in the extending tube, the lower section of said lead-entering tube being slidable inside the extending tube;

groove means formed in the lower section of the lead-entering tube which cooperates with the projection means of the extending tube; and radial projection means provided inside said cup means to position the lead-entering tube.

4. A cartridge as claimed in claim 2, wherein two ends of a lead-feeding spring act on the upper end of the locking element and the lower end of the lead-entering tube respectively.

5. A cartridge as claimed in claim 3, wherein two ends of a lead-feeding spring act on the radial projection means of said cup means and the lower end of the lead-storing tube.

6. An automatic-pencil cartridge, comprising:

lead automatic compensation means, disposed in a front section of the cartridge, for automatically outputting lead when depressed, said lead automatic compensation means including:

a lead-protecting element;

a damping ring which is disposed in said lead-protecting element; and a front spring, one end of which abuts the lead protecting element;

lead holding means disposed in a middle section of the cartridge for delivering lead to an exit of the cartridge, said lead holding means including:

a locking element which moves forward and backward and in which locking element a central hole is formed, said central hole having a tapered section at one end thereof; and a holding element which is arranged in said locking element and which holding element engages with the tapered section of said locking element, said holding element having a central hole in which central hole a tapered surface is provided, wherein another end of said front spring abuts said holding element;

lead storing means disposed in a back section of the cartridge for storing the lead and opening said holding element, said lead storing means including:

a lead guiding tube fixedly mounted in said lead storing means which lead guiding tube extends into the central hole of said holding element and cooperates with the tapered surface of said holding element so that said holding element is opened when the tapered surface is pressed by said lead guiding tube;

a lead entering tube which fixedly and partially encases said lead guiding tube, said lead entering tube comprising a thick section and a thin section, a shoulder being formed between the thick section and the thin section; and a lead storing tube which fixedly encases the thin section of said lead entering tube; and cup means for enclosing said lead automatic compensation means and said lead holding means, and which receives said lead storing means at a back section of the cup means, and in which the locking means can slide therealong, including:

a retaining element to enclose a front end of the cup means and which provides an outer surface of the cartridge with a shoulder, said lead protecting element extending out of said retaining element.

7. A cartridge as claimed in claim 6, further comprising:

an extending tube which is hollow and which fixedly engages with the locking element at one end of the extending tube, the thick section of said lead entering tube being slidably arranged inside said extending tube;

projection means formed on an inner surface of said extending tube;

groove means formed in the thick section of said lead-entering tube which can engage with the projection means of said extending tube;

radial projection means provided inside said cup means for positioning the shoulder of the lead-entering tube and for positioning another end of said extending tube opposed to said one end fixedly engaging with said locking element; and a lead feeding spring arranged between the radial projection means of said cup means and one end of said lead storing tube where said lead entering tube is received, said lead feeding spring being compressed by the displacement of said lead storing tube.

8. A cartridge as claimed in claim 6, further comprising a lead feeding spring arranged between said lead storing tube and said lead holding means; and a step means is formed inside said cup means to position said locking element.

9. A cartridge as claimed in claim 6 wherein steel balls are provided in cavities formed at an outer surface of said holding element, said steel balls engaging slidably with the tapered section of said locking element to lock or release the lead extending through the central hole of the locking element.

10. A cartridge as claimed in claim 9 wherein said holding element comprises two semi-columnar parts.

11. A cartridge as claimed in claim 9 wherein said holding element is made of a single tube with longitudinal grooves formed in its side wall.

12. An automatic pencil cartridge, comprising:

a tip element through which a lead is fed, said tip element including a damping ring for frictionally retaining said lead;

lead holding means arranged axially behind said tip element, said lead holding means including an interior part and an exterior part, said interior part being axially movable with respect to said exterior part from a first relative position wherein said interior part frictionally retains said lead to a second relative position wherein said lead is not frictionally retained by said interior part;

lead storing means arranged axially behind said lead holding means, said lead storing means including a lead guiding tube fixedly mounted in said lead storing means, said interior part of the lead holding means includes a central hole having a tapered end in alignment with said lead guiding tube; and said lead guiding tube includes means for engaging said tapered end to retain said lead holding element in the second relative position to permit axial shifting of the lead with respect to said lead holding element while said lead guiding tube is disposed within the central hole of the interior part while the lead storing means is retracted axially with respect to the lead and while said damping ring frictionally retains a position of said lead with respect to the tip element.

13. The automatic pencil cartridge of claim 12, further comprising spring means, one end of which abuts the tip element, for cooperating with the tip element and the damping ring to automatically advance the lead when the lead has become worn from writing.

14. The automatic pencil cartridge of claim 12, further comprising:

an extending tube connected to the exterior part, the extending tube having an annular projection on an inner surface of the extending tube; and a lead entering tube encasing the lead guiding tube, the lead entering tube having a thin section and a thick section, wherein a shoulder is formed between the thin section and the thick section, the lead entering tube having a groove on an outer surface of the thick section which groove cooperates with the annular projection of the extending tube.

15. An automatic pencil cartridge, comprising:

a tip element through which a lead is fed, said tip element including a damping ring for frictionally retaining said lead;

lead holding means arranged axially behind said tip element, said lead holding means including an interior part and an exterior part, said interior part being axially movable with respect to said exterior part from a first relative position wherein said interior part frictionally retains said lead to a second relative position wherein said lead is not frictionally retained by said interior part;

lead storing means arranged axially behind said lead holding means, said lead storing means including a lead guiding tube fixedly mounted in said lead storing means;

said interior part of the lead holding means includes a central hole having a tapered end in alignment with said lead guiding tube;

said lead guiding tube includes means for engaging said tapered end to retain said lead holding element in the second relative position to permit axial shifting of the lead with respect to said lead holding element while said lead guiding tube is disposed within the central hole of the interior part while the lead storing means is retracted axially with respect to the lead and while said damping ring frictionally retains a position of said lead with respect to the tip element;

an extending tube fixedly connected with the exterior part and having an annular projection on an inner surface of the extending tube;

said lead storing means further including a lead entering tube which encases said lead guiding tube, and has a thicker portion and a thinner portion, wherein the thicker portion has a groove which cooperates with the annular projection of the extending tube; and said lead entering tube further including shoulder means, separating said thicker portion and said thinner portion, for abutting with the annular projection to maintain the lead holding means in the second relative position while the lead storing means is retracted axially with respect to the lead.

16. The automatic pencil cartridge of claim 15, further comprising spring means, one end of which abuts the tip element, for cooperating with the tip element and the damping ring to automatically advance the lead when the lead has become worn from writing.

* * * * *